United States Patent [19]

Noguchi et al.

[11] Patent Number: 4,488,957

[45] Date of Patent: Dec. 18, 1984

[54] METHOD AND APPARATUS FOR PRODUCTION OF CRYSTALLIZABLE CARBONACEOUS MATERIAL

[75] Inventors: Kosaku Noguchi, Tokyo; Honami Tanaka, Osaka; Yukimasa Kumura, Osaka; Eiji Kitajima, Osaka; Toshifumi Ishitobi, Osaka; Hirokazu Teraoka, Osaka, all of Japan

[73] Assignee: Koa Oil Company, Ltd., Tokyo, Japan

[21] Appl. No.: 382,360

[22] Filed: May 26, 1982

[30] Foreign Application Priority Data

Jun. 1, 1981 [JP] Japan ..... 56-83965

[51] Int. Cl.[3] ..... C10C 3/00; D01F 9/12; D01F 9/20

[52] U.S. Cl. ..... 208/40; 208/22; 208/39; 208/44; 423/447.2; 423/447.4

[58] Field of Search ..... 208/22, 39, 40, 44, 208/45; 423/447.2, 447.4, 447.6, 449

[56] References Cited

U.S. PATENT DOCUMENTS

| | | | |
|---|---|---|---|
| 2,315,935 | 4/1943 | Child | 208/39 |
| 2,878,650 | 3/1959 | Kachma | 208/39 |
| 2,896,261 | 7/1959 | McAfee | 208/39 |
| 3,490,586 | 1/1970 | Jaisle | 208/44 |
| 3,974,264 | 8/1976 | McHenry | 423/448 |
| 3,976,729 | 8/1976 | Lewis et al. | 423/447.8 |
| 4,017,327 | 4/1977 | Lewis et al. | 423/447.4 |
| 4,080,283 | 3/1978 | Noguchi et al. | 208/22 |
| 4,184,942 | 1/1980 | Angier et al. | 423/447.1 |
| 4,209,500 | 6/1980 | Chwastiak | 208/22 |
| 4,303,631 | 12/1981 | Lewis et al. | 208/44 |
| 4,363,670 | 12/1982 | Noguchi et al. | 208/45 |
| 4,381,990 | 5/1983 | Noguchi et al. | 208/45 |

FOREIGN PATENT DOCUMENTS

| | | | |
|---|---|---|---|
| 2086932 | 5/1982 | United Kingdom | 208/40 |

*Primary Examiner*—Carl F. Dees
*Assistant Examiner*—Helane E. Maull
*Attorney, Agent, or Firm*—Wenderoth, Lind & Ponack

[57] ABSTRACT

A heavy oil such as an atmospheric pressure residue, a reduced pressure residue of petroleum, etc. is heated to 400° to 500° C. to carry out polycondensation and provide a pitch containing mesophase microspheres. This pitch is once cooled to 200° to 400° C. and a turbulent flow is imparted thereto to cause agglomeration of the mesophase microspheres. The resulting agglomerates are separated to obtain a crystallizable material enriched with quinoline insolubles. Production of the crystallizable material is preferably conducted in a separation tank accommodating the lower part of a heating polycondensation reactor (6) and having a stirring device (12).

10 Claims, 9 Drawing Figures

METHOD AND APPARATUS FOR PRODUCTION OF CRYSTALLIZABLE CARBONACEOUS MATERIAL

TECHNICAL FIELD

This invention relates to a method for producing a crystallizable material comprising mesophase agglomerates and to an apparatus therefor.

BACKGROUND ART

When a hydrocarbon type heavy oil such as a petroleum heavy oil, coal tar or oil sand is carbonized by heat treatment at 400° to 500° C., microcrystals called mesophase microspheres are formed in the molten heat-treated pitch obtained at the early stage of the heat treatment. The mesophase microspheres are liquid crystals having specific molecular arrangements. They are carbonaceous precursors for affording highly crystalline carbonized products. Also, since they themselves have high chemical and physical activities, they are expected, by being isolated from the above mentioned heat-treated pitch (isolated mesophase microspheres are generally called as mesocarbon microbeads), to be utilized for a wide scope of applications having high added values, including that as starting materials for high-quality carbon materials and starting materials for carbon fibers, binders, adsorbents, etc.

For isolation of such mesophase microspheres, there has been proposed a method in which only the pitch matrix containing these microspheres dispersed therein was dissolved selectively in quinoline, pyridine, or an aromatic oil such as anthracene oil, solvent naphtha, or the like, and the mesophase microspheres as insolubles are recovered by solid-liquid separation. However, in order to perform the heat treatment while avoiding coke formation, the content of the mesophase microspheres in the heat-treated pitch (as determined quantitatively as quinoline insolubles according to Japanese Industrial Standards JIS K2425) can be increased only to at most 15% by weight. It is also necessary to use a solvent in an amount of 30 times or more the weight of the heat-treated pitch. Accordingly, in the method for isolating the mesophase microspheres by selective dissolution of the matrix pitch as described above (hereinafter sometimes referred to as "the solvent separation method"), it is necessary to use a solvent in an amount of 200 times or more the mesophase microspheres to be obtained, whereby productivity is inevitably extremely lowered.

In view of the state of the art as described above, we have previously developed and proposed a process for producing continuously mesocarbon microbeads (isolated product of mesophase microspheres) by means of a liquid cyclone (Japanese Patent Application No. 238/80; U.S. patent application Ser. No. 222,901 now U.S. Pat. No. 4,363,670). This process can enhance productivity by consistent continuity of the steps and effective utilization of solvents and may be considered to be effective as a method for production of mesocarbon microbeads. However, this method, which belongs basically to the solvent separation method, also entails the disadvantage of employing a large quantity of a solvent.

SUMMARY OF THE INVENTION

It is an object of the present invention to provide a method for separating mesophase substances from the matrix pitch based on a principle entirely different from that of the solvent separation method as described above and to provide an apparatus therefor.

We have speculated that the difficulty encountered in the separation of the mesophase from the matrix pitch might be due to the fact that the former is dispersed as microspheres in the latter, and we also had an idea that the mesophase might not necessarily be in the form of microspheres. As a result of further progress of our study, we have found that the mesophase microspheres can be united by agglomeration by cooling once the heat-treated pitch and imparting a turbulent flow to the cooled pitch, whereby separation from the matrix pitch is greatly facilitated without application of the solvent separation method.

The method for production of a crystallizable carbonaceous material of this invention is based on the above finding and, more particularly, comprises preparing a pitch containing mesophase microspheres by carrying out a polycondensation reaction by heating a heavy oil at 400° to 500° C., and thereafter cooling the pitch to 200° to 400° C., and imparting a turbulent flow to the cooled pitch, thereby agglomerating the mesophase microspheres to be separated from the matrix pitch.

The apparatus for production of a crystallizable material according to the present invention is suitable for practicing the above method and, more particularly, comprises a combination of a heating polycondensation reactor, having an inlet for a heavy oil at the upper part and an outlet for discharging the heat-treated pitch at the lower part and a separation tank, accommodating at least the lower part of said heating polycondensation reactor and having a stirring device together with an outlet for removing the matrix pitch at the upper part and an outlet for removing the agglomerated mesophase at the bottom part.

The nature, utility and further features of this invention will be more clearly apparent from the following detailed description, beginning with a consideration of general aspects of the invention and concluding with specific examples of practice thereof, when read in conjunction with the accompanying drawings and photomicrographs, briefly described below.

BRIEF DESCRIPTION OF THE ILLUSTRATIONS

In the illustrations:

Figure 3A:
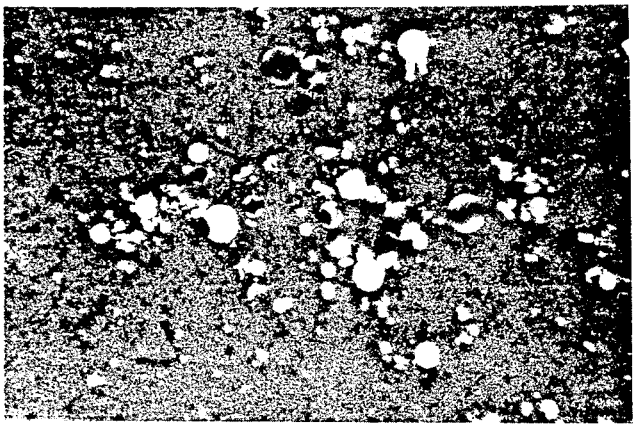
Figure 3B:
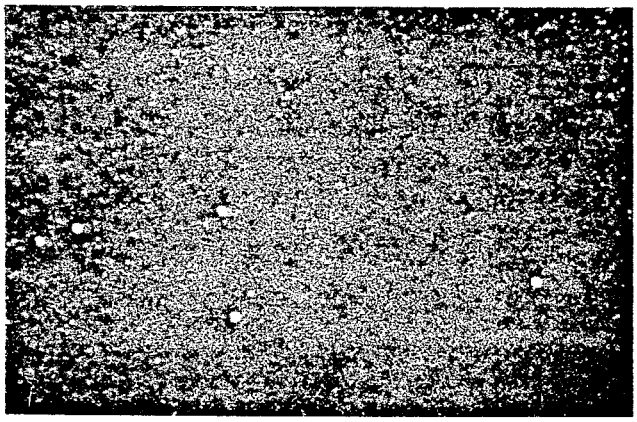
Figure 3C:
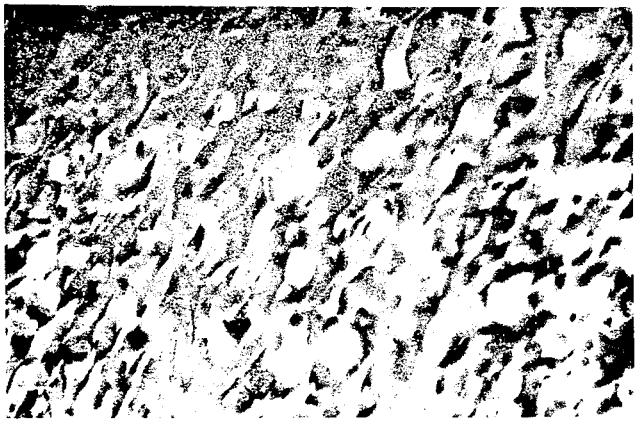
Figure 4:
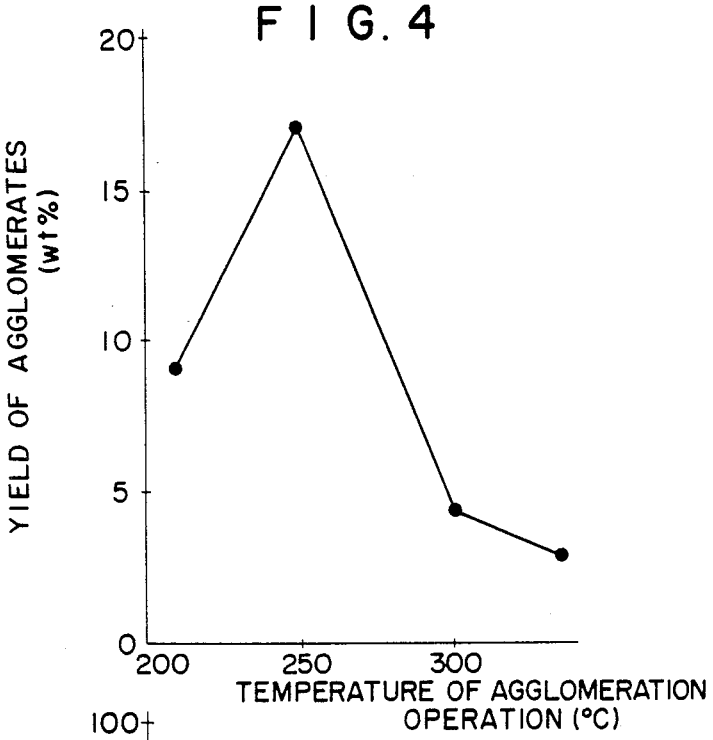
Figure 5:
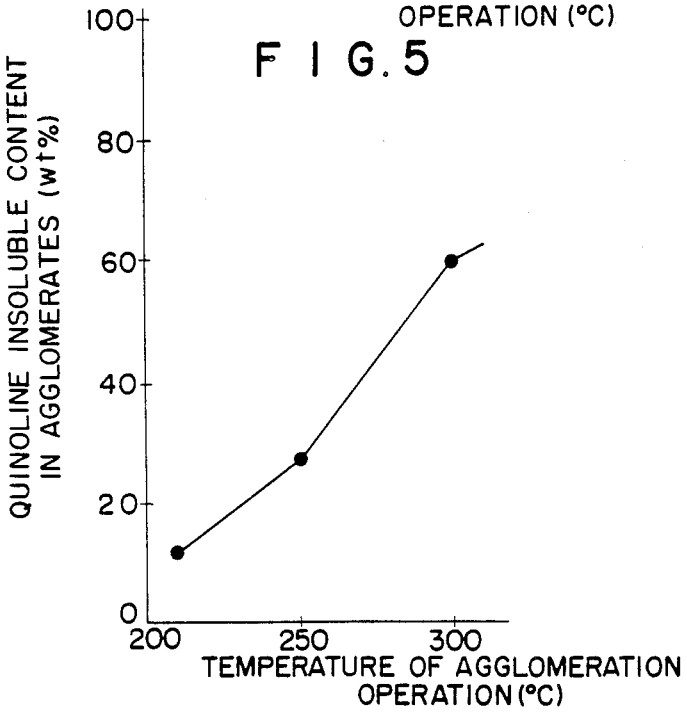
Figure 6:
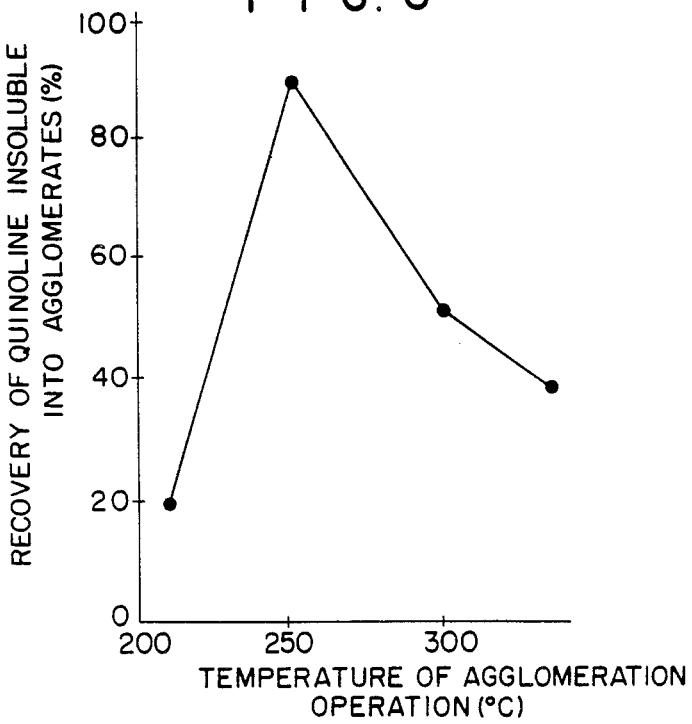
Figure 7:
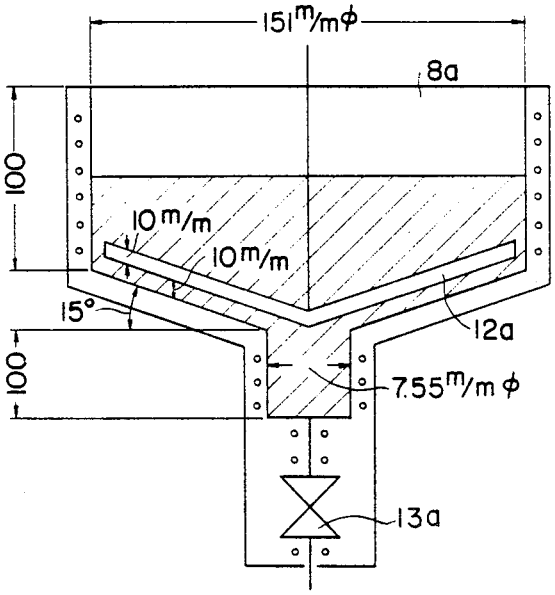

FIGS. 3*a*, 3*b*, and 3*c* are polarization photomicrographs of the heat-treated pitch, the matrix pitch, and the agglomerate, respectively;

FIGS. 4, 5, and 6 are graphs showing dependency of the yield of the agglomerate, quinoline insolubles content, and the recovery of the quinoline insolubles, respectively, on the separation operational temperature; and FIG. 7 is a schematic illustration of the separator (type II) used in the Examples of the present invention.

DETAILED DESCRIPTION OF THE INVENTION

In the following description, "%" and "parts" are by weight, unless otherwise noted.

As the starting heavy oil to be used in the present invention, those having a specific gravity (15/4° C.) of 0.900 to 1.350 and a Conradson carbon residue of 5 to 55% may be used. As such a heavy oil, more specifically, any of petroleum heavy oils such as normal pressure distillation residue and reduced pressure distillation residue, decant oils obtained by catalytic cracking, thermally cracked tars of petroleum, coal tars, oil sand oil, etc., may be employed.

These heavy oils are subjected to a heat treatment at a reaction temperature of 400° to 500° C., preferably 400° to 460° C. for about 30 minutes to 5 hours thereby to form mesophase microspheres in the pitch within limits such that no coke-like bulk mesophase or coke-like carbonized product will be formed through excessive reaction. By such a heat treatment, a heat-treated pitch containing generally 1 to 15%, particularly 5 to 15%, of mesophase microspheres can be obtained.

As the next step, the above heat-treated pitch is cooled from the polycondensation reaction temperature and subjected to a turbulent flow thereby to agglomerate the mesophase microspheres. The temperature conditions for agglomerating the mesophase microspheres, under which the pitch matrix has sufficient fluidity and the mesophase microspheres have sufficient viscosity to be united through collision, differs depending on the starting heavy oil employed, but it is preferably a temperature lower by 50° to 200° C. than the polycondensation temperature, particularly in the range of from 200° to 400° C., more preferably from 250° to 400° C., most preferably from 300° to 350° C.

When the temperature is too low, the viscosity of the pitch matrix is high and inhibits migration of mesophase microspheres, and further the mesophase microspheres per se lack tackiness, whereby no effective agglomeration can occur to lower remarkably the yield of the mesophase content in the agglomerate. Furthermore, the mesophase content in the agglomerate is also lowered and the power required for imparting a turbulent flow is increased. On the other hand, when the temperature is excessively high, the agglomerating characteristics in the pitch matrix is good, but the viscosity of the mesophase microspheres is lowered to give rise to disintegration and redispersion of the agglomerate by the turbulent flow, thus inviting lowering in the yield of the mesophase spherical agglomerate. The pressure employed is usually atmospheric pressure, but pressurization or reduced pressure may also be used, if desired.

For imparting a turbulent flow to the heat-treated pitch, the possible methods are the method of passing it through an orifice, the line blending method, the jet nozzle method and others. However, as the most simple method, stirring is employed. The degree of turbulence may be determined optimally to the end that a desirable effective agglomeration of mesophase microspheres will be obtained. More specifically, the degree of turbulence will be suitable for obtaining a good agglomeration effect when it is such that the quinoline insolubles content in the agglomerate recovered by precipitation separation is twice or more than in the starting pitch and is at least 10%, preferably 25% or more, particularly 50% or more. One measure is to attain a Reynolds number (including stirring Reynolds number) of 3,000 or more. The time for imparting a turbulent flow varies depending on the method employed for imparting the turbulent flow and may be determined as desired within the range which can give the above agglomerating effect. For example, in the case of the stirring method, 1 to 15 minutes is sufficient. Of course, stirring can be continued for a longer time.

The agglomerate is then recovered from the matrix pitch. Ordinarily, the agglomerate is sedimented at the bottom of a vessel through difference in specific gravity and can be drawn out from the bottom portion. It is also possible on a small scale to resort to decantation or skimming by means of a metal net.

The agglomerate thus obtained still contains about 20 to 70% of the matrix pitch. Accordingly, if necessary, its purity can be improved by washing with quinoline, pyridine, or an aromatic oil such as anthracene oil or solvent naphtha. However, this procedure is fundamentally different from the solvent separation method as described above with respect to yield as well as the amount of the solvent required.

Figure 1:
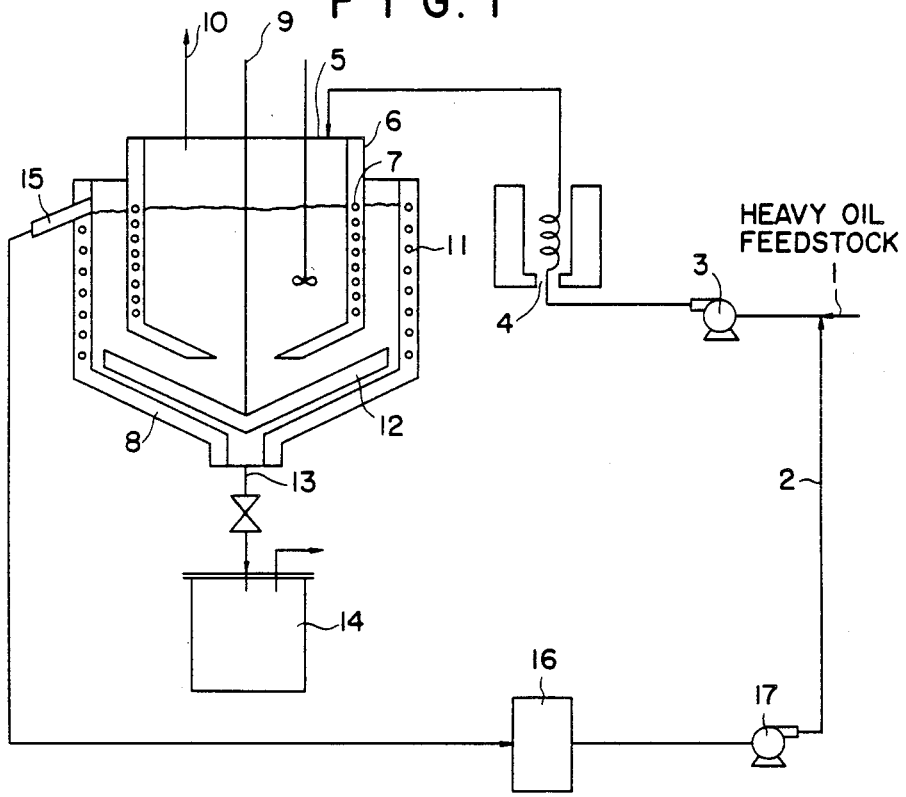
FIG. 1 is a chart of arrangement showing schematically one embodiment of the apparatus for producing a crystallizable material according to the present invention.

Referring now to FIG. 1, one example of practice of the above described method by means of an example of the apparatus for production of a crystallizable material of the present invention will be described below.

A heavy oil, which is the starting material, is fed through a pipeline 1 at a rate of 140 g/minute and delivered together with a matrix pitch recovered from a pipeline 2 at a rate of 860 g/minute by a pump 3 into a preheater 4, wherein the fluids are heated and then fed into a reactor 6 through a reactor inlet 5. Alternatively, the matrix pitch recovered may also be preheated in an independent preheated (not shown), separately from the starting heavy oil, and thereafter fed into the reactor 6. The reactor 6 of a total volume of 100 liters is maintained at 450° C. by a heater 7, and its lower portion is immersed in a separation tank 8. The starting oil is given a residence time of about 60 minutes by adjustment of the residence volume of the reactants by adjusting the relative positional relation between the reactor 6 and the separation tank 8, during which time a polycondensation reaction is caused to proceed under stirring by means of a stirring device 9, while light components formed by decomposition are drawn out from a pipe 10 at the top at a rate of about 100 g/minute.

The heat-treated pitch formed in the reactor 6 contains about 5% of mesophase microspheres and flows down into the separation tank 8 successively as the starting oil flows into the reactor through the inlet 5. The separation tank 8 has a volume of about 100 liters and, while it is controlled at about 340° C. by a heater 11, it is stirred and caused to undergo a rotational flow at the conical portion of the lower part by a blade 12 rotating at 10 RPM. The rotating blade 12 has the same shape as shown in FIG. 7 as hereinafter described and is a vertical blade with a height of 20 mm and a blade length of 700 mm, which is placed parallel to the conical bottom portion with a gap of 10 mm therefrom. In general, the gap between the blade and the bottom of the separation tank is preferably 20 mm or less, particularly in the range of from 5 to 10 mm.

The mesophase microspheres undergo collision and agglomeration caused by the rotation of the blade 12, and the resulting agglomerates flow down along the vessel at the conical bottom similarly as in a continuous thickener and is drawn out from the discharging outlet 13 at the bottom into the agglomerate tank 14 as an agglomerate containing about 67% of mesophase at a rate of 40 g/minute.

On the other hand, the matrix pitch containing about 2% of mesophase flows out from an overflow outlet 15 provided at the upper side wall of the separation tank 8, is stored in a reflux tank 16 and circulated again to the reactor 6 via a pump 17 and the conduit 2.

The above described apparatus is characterized in that it is a continuous apparatus having a small installation area as well as a high thermal economy afforded by combining the reactor and the separation tank integrally to obtain a compact arrangement of the whole apparatus. In particular, by eliminating the use of a liquid level controller and an instrument for controlling the quantity of pitch drawn out from the reactor, it becomes possible to prevent troubles which are liable to occur in an apparatus of this kind for treating a high temperature viscous fluid.

As described above, according to the present invention, there is provided a method in which mesophase microspheres can be effectively separated from the matrix pitch by agglomerating mesophase microspheres contained in a heat-treated pitch by a simple procedure of imparting a turbulent flow to the heat-treated pitch and also a compact continuous apparatus therefor.

In order to indicate more fully the nature and utility of this invention, the following examples are set forth, it being understood that these examples are presented as illustrative only and are not intended to limit the scope of the invention.

EXAMPLE 1

Into a reaction vessel of 4-liter capacity (inner diameter: 130 mm; height: 300 mm.), there was charged 2 kg of a decant oil obtained from a fluid catalytic cracking device, and heating treatment was conducted under a nitrogen gas atmosphere. The heat treatment was conducted by elevating the temperature at a rate of 3° C./minute up to 450° C. and maintaining the temperature at 450° C. for 90 minutes to produce 0.8 kg of a heat-treated pitch.

Figure 2:
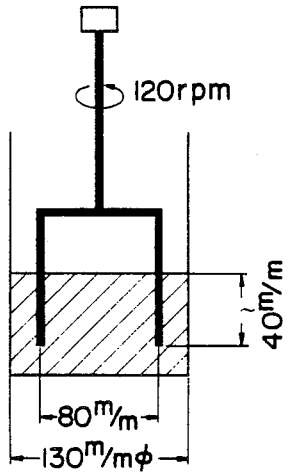
FIG. 2 is a schematic illustration of the separator (type I) used in the Examples of the method according to the present invention.

The heat-treated pitch was left to cool to 350° C. and passed through a metal net having meshes of 1 mm×1 mm to remove the coke-like bulk mesophase and the coke-like carbonized product. The resultant pitch fraction contained 5.0% (based on pitch) of mesophase microspheres measured as quinoline insolubles (according to JIS K2425; hereinafter the same). The pitch fraction was poured into a separator as shown in FIG. 2 (inner diameter: 130 mm, height 300 mm, volume 4 liters; this is called a separator of type I) and the pitch temperature was maintained at 335° C., while being stirred by means of a stirrer having a pair of vertical round rods of about 7-mm diameter spaced apart 80 mm and a rotary shaft fixed to the central point thereof and driven at a rotational speed of 120 rpm. This stirrer was immersed to a depth of 40 mm.

Then, the contents were immediately passed through a metal net having meshes of 1 mm×1 mm to obtain 2.9% of agglomerates based on the total weight of the pitch on the metal net. The agglomerates contained 69.2% of quinoline insolubles which were concentrated to 13.8 times that of the starting pitch (5%). The recovery percentage of quinoline insolubles is 40.1%. For the purpose of reference, the polarization photomicrographs (×175) of the starting pitch, the matrix pitch, and the agglomerate passed through the metal net, respectively, are shown in FIGS. 3*a*, 3*b*, and 3*c*. It can be seen that the mesophase microspheres exhibiting optical anisotropy in the starting pitch (FIG. 3*a*) are united and concentrated as agglomerates (FIG. 3*c*).

EXAMPLES 2, 3, AND 4

The procedure of Example 1 was repeated except that only the separation operational temperature was changed to 300° C. (Example 2), 250° C. (Example 3) and 210° C. (Example 4), respectively. The results are shown in Table 1 below and also in FIGS. 4, 5, and 6.

From FIGS. 4, 5, and 6, it can be seen that the quinoline insolubles are increased with elevation of the operational temperature (FIG. 5), but the yield of agglomerates is lowered with temperature elevation (FIG. 4) with concomitant decrease in recovery percentage (FIG. 6). These relationships as well as the economy in operation will determine the operational temperature.

EXAMPLE 5

The pitch fraction prepared similarly under the same conditions as in Example 1 and obtained by passing through a metal net was cooled once to room temperature (24° C.) to obtain a solid pitch. As the next step, this was heated again to a liquid pitch at 300° C., and thereafter stirring treatment and separation treatment were carried out at this temperature similarly as in Example 1.

EXAMPLE 6

The procedure of Example 1 was repeated except that the stirring operational temperature was changed to 300° C. and the stirring time to 15 minutes.

EXAMPLES 7 AND 8

By using a coal tar obtained by extraction of only toluene solubles from a commercially available anhydrous tar (standard product according to JIS K2439) as the starting oil, and following subsequently the procedure in Example 1, a heat-treated pitch was obtained. Further, the same stirring and separation procedures were applied as in Example 1 with stirring temperatures of 340° C. (Example 7) and 290° C. (Example 8).

The results of Examples 5 to 8 are also given in Table 1.

EXAMPLE 9

Into a separator 8*a* (called a separator of type II) of about 1.8-liter inner volume as shown in FIG. 7 with a structure similar to the separation tank 8 as shown in FIG. 1, 1 kg of the pitch prepared by the heat-treatment similarly as in Example 1 was introduced, and the stirring blade 12*a* was rotated at 50 rpm for 5 minutes while the temperature was maintained at 340° C. This step was followed immediately by removal of 43 g of the agglomerates by opening of the discharge valve 13*a*. The yield of the agglomerates obtained was 4.3%, the quinoline insolubles content being 67.3%.

EXAMPLE 10

Example 9 was repeated except that the pitch temperature under stirring was changed to 370° C., whereby the agglomerate yield was found to be 4.4% and the quinoline insolubles content 64.5%.

The results of Examples 9 to 10 are also set forth in Table 1 below. As is apparent from the results of Table 1, by imparting a turbulent flow by stirring to heat-treated pitch containing mesophase microspheres at a temperature range of from 210° to 370° C., the mesophase microspheres can be effectively agglomerated to produce agglomerates with a high content of quinoline insolubles, that is, crystallizable material.

TABLE 1

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Pitch preparation conditions: | | | | | | | | | | |
| Starting oil | Decant oil | Decant oil | Decant oil | Decant oil | Decant oil | Decant oil | Coal tar | Coal tar | Coal tar | Coal tar |
| Heat treatment temperature | 450° C. | 450° C. | 450° C. | 450° C. | 450° C. | 450° C. | 440° C. | 440° C. | 440° C. | 440° C. |
| Retention time | 90 min. | 90 min. | 90 min. | 90 min. | 90 min. | 90 min. | 90 min. | 90 min. | 90 min. | 90 min. |
| Pitch yield | 40 wt % | 40 wt % | 40 wt % | 40 wt % | 40 wt % | 40 wt % | 40 wt % | 40 wt % | 40 wt % | 40 wt % |
| Quinoline insolubles content in pitch | 5 wt % | 5 wt % | 5 wt % | 5 wt % | 5 wt % | 5 wt % | 1.9 wt % | 1.9 wt % | 1.9 wt % | 1.9 wt % |
| Agglomeration conditions: | | | | | | | | | | |
| Separator volume | 4 l | 4 l | 4 l | 4 l | 4 l | 4 l | 4 l | | 1.8 l | 1.8 l |
| Separator temperature | 335° C. | 300° C. | 250° C. | 210° C. | Room temp. (24° C.) | 300° C. | 340° C. | 290° C. | 340° C. | 370° C. |
| Kind of separator | Type I | Type I | Type I | Type I | Type I | Type I | Type I | Type I | Type II | Type II |
| Stirring speed | 120 rpm | 120 rpm | 120 rpm | 120 rpm | 120 rpm | 120 rpm | 120 rpm | 120 rpm | 50 rpm | 50 rpm |
| Stirring time | 2 min. | 2 min. | 2 min. | 2 min. | 2 min. | 15 min. | 2 min. | 2 min. | 5 min. | 1 min. |
| Pitch temperature | 335° C. | 300° C. | 250° C. | 210° C. | 300° C. | 300° C. | 340° C. | 290° C. | 340° C. | 370° C. |
| Separation results: | | | | | | | | | | |
| Yield: Agglomerate | 2.9 wt % | 4.4 | 17.0 | 9.1 | 6.8 | 4.7 | 2.0 | 10.2 | 5.1 | 4.9 |
| Pitch | 97.1 wt % | 95.6 | 83.0 | 90.9 | 93.2 | 95.3 | 98.0 | 89.8 | 94.9 | 95.1 |
| Quinoline insolubles content in agglomerate | 69.2 wt % | 59.6 | 27.0 | 11.9 | 59.7 | 57.7 | 64.9 | 12.6 | 67.3 | 64.5 |
| Concentration degree *1 | 13.8 | 11.9 | 5.4 | 2.4 | 12.0 | 11.5 | 34.2 | 6.6 | 13.5 | 12.9 |
| Recovery percent *2 | 40.2 wt % | 52.4 | 91.8 | 21.6 | 81.2 | 54.2 | 68.4 | 67.9 | 68.6 | 63.2 |

*1: (Quinoline insolubles content in agglomerate) ÷ (Quinoline insolubles content in starting pitch)
*2: (Quinoline insolubles in agglomerate × Yield of agglomerate) ÷ (Quinoline insolubles content in starting pitch × 100) × 100

What we claim is:

1. A method of producing a crystallizable carbonaceous material which comprises:
   (1) heating a heavy oil at a temperature of 400° to 500° C. and for a time sufficient to carry out a polycondensation reaction thereby producing a pitch containing mesophase microspheres;
   (2) cooling the thus-produced pitch at a temperature between 200° to 400° C., provided that the cooling temperature is from 50° to 200° C. lower than the polycondensation reaction temperature;
   (3) subjecting the thus-cooled pitch at a temperature between 200° to 400° C. to a turbulent flow sufficiently to agglomerate the mesophase microspheres containing quinoline insolubles; and
   (4) separating the agglomerates from the pitch.

2. A method according to claim 1 wherein the pitch is cooled at a temperature of 300° to 350° C.

3. A method according to claim 1 wherein the heavy oil is heated for about 30 minutes to 5 hours.

4. A method according to claim 1 wherein the stirring is effected for 1 to 15 minutes.

5. A method according to claim 1, wherein the pitch produced in step (1) containing mesophase microspheres contains 1 to 15% by weight of quinoline insolubles, and wherein the agglomerates of the mesophase microspheres obtained by subjecting the cooled pitch to turbulence contains quinoline insolubles which are at least twice that contained in the starting pitch and which are at least 10% by weight of the thus-obtained agglomerates.

6. A method according to claim 5, wherein agglomerates with a quinoline insolubles content of 25% or more are obtained.

7. A method according to claim 1, wherein the temperature for imparting the turbulent flow is 250° to 400° C.

8. A method according to claim 1, wherein the turbulent flow is imparted to the cooled pitch by stirring.

9. A method according to claim 1, wherein the agglomerates are separated by sedimentation separation from the matrix pitch.

10. A method according to claim 1, further comprising the step of enhancing the quinoline insolubles content by washing the agglomerates recovered with an aromatic oil.

* * * * *